US007297095B2

(12) United States Patent
Zachary

(10) Patent No.: US 7,297,095 B2
(45) Date of Patent: Nov. 20, 2007

(54) ROTARY TORSO EXERCISE BENCH

(76) Inventor: Kyriacos Mark Zachary, 819 W. Seminary Ave., Lutherville, MD (US) 21093

( * ) Notice: Subject to any disclaimer, the term of this patent is extended or adjusted under 35 U.S.C. 154(b) by 84 days.

(21) Appl. No.: 10/547,870

(22) PCT Filed: Feb. 25, 2004

(86) PCT No.: PCT/US2004/005667

§ 371 (c)(1),
(2), (4) Date: Sep. 2, 2005

(87) PCT Pub. No.: WO2004/078268

PCT Pub. Date: Sep. 16, 2004

(65) Prior Publication Data

US 2006/0172869 A1 Aug. 3, 2006

(51) Int. Cl.
*A63B 26/00* (2006.01)
*A63B 71/00* (2006.01)

(52) U.S. Cl. ..... 482/142; 482/94

(58) Field of Classification Search ..... 482/142; D21/676, 686, 690, 94–96
See application file for complete search history.

(56) References Cited

U.S. PATENT DOCUMENTS 6,015,370 A * 1/2000 Pandozy ..... 482/97
6,468,191 B1 * 10/2002 Cameron ..... 482/140

* cited by examiner

*Primary Examiner*—Lori Amerson
(74) *Attorney, Agent, or Firm*—Ober/Kaler; Royal W. Craig

(57) ABSTRACT

A rotary torso exercise machine that isolates and targets the internal and external oblique muscles on both sides of the torso as well as providing conditioning to the rectus abdominis muscle. The machine supports a user's body in a generally supine position and includes five essential features, a frame, fixed feet stabilizing rollers, a fixed lower torso support or seat, a rotatable upper torso support, and a peg for holding free weights that impart resistance against the rotation of the upper torso support. The user may selectively vary the mount and direction of resistance as well as the degree of rotation. The machine may be easily converted for use as either a back or abdominal exercise.

15 Claims, 9 Drawing Sheets

ROTARY TORSO EXERCISE BENCH

TECHNICAL FIELD

The present invention relates to an exercise machine. Specifically, it relates to a rotary torso exercise machine.

BACKGROUND ART

Rotary torso exercises are used to workout the mid-section of the body. Specifically, these exercises target the oblique muscles on both sides of the midsection. Rotating your torso to the right works the right internal and left external oblique muscles. Rotating your torso to the left works the left internal and right external oblique muscles. The rectus abdominis muscle is also involved in both movements. Thus, rotary torso exercises are ideal for overall midsection strengthening. Conditioning the rotary torso muscles is particularly important for sports requiring a swinging motion, such as golf, baseball, tennis, hockey, lacrosse, etc., not only to improve the swing, but to prevent injury. Rotary torso exercise machines are exercise machines, which use resistance or weights, to facilitate these rotary torso exercises.

Commercial use exercise machines for gyms and the like typically target one muscle group and are set up as stations. Users move from station to station to perform a variety of exercises on different muscle groups. Exercise machines that target rotary torso muscles, particularly, traditionally have an arrangement similar to that disclosed in U.S. Pat. No. 4,456,245 to Baldwin issued Jun. 26, 1984. The rotary torso machine is configured so that a user's body is supported in a generally upright seated position, upper and lower torso portions are engaged so as to restrict movement of the user's body to rotary movement of the upper torso relative to the lower torso about an axis extending longitudinally of the user's body, and force (by means of weights in this instance) is imposed to resist such movement.

Many exercise machines, often designed for home use or smaller gyms, are configured to allow the user to perform a variety of exercises, including rotary torso exercises. Because of the multi-use configurations these machines oftentimes are not able to provide the best exercise for any given muscle/muscle group. For example, U.S. Pat. No. 6,015,370 to Pandozy issued on Jan. 18, 2000, discloses an apparatus and a method for performing four exercises including the rotation or torsion of the lower spine and the lower back muscles. As shown in FIG. 8, the user is lying on his back with his upper torso stationary, hips flexed and squeezing one end of a bar between his thighs/knees. The bar is perpendicular to the ground and weights are stacked on a pin at the other end of the bar. At some point between the opposing ends the bar is rotatably mounted on an axle. The exercise is performed by rotation of the hips to the right or left, using stacked free weights as resistance. Another exercise machine advertised on-line by http://www.quantumfitness.com/ab/roto_crunch.shtml, combines a number of mid-torso and abdominal exercises, including a rotary torso machine, on one machine, with the user in the seated position.

Rotary torso exercises with the greatest benefit, are performed with the hips at least partially extended in either a standing or supine position (vice a seated position with hips flexed), so that the targeted oblique and rectus abdominas muscles are able reach maximum extended and flexed positions. In a seated positioned the hips are flexed such that the targeted muscles are necessarily slightly flexed and unable to reach maximum extension during the rotary torso exercises. Performing the exercise in a supine position with hips at least partially extended, vice sitting or standing, also reduces pressure and weight on the lower back and spine, allowing the user to work the targeted area without stress to other areas. Allowing the user to selectively vary the resistance levels as well as the degrees and directions of rotation, further increases the user's ability to effectively target and condition specific muscles in the torso area.

It would be advantageous over the prior art to provide a rotary torso machine, suitable for commercial use, in which a user's body is supported in a generally supine position with hips at least partially extended with the upper and lower torso portions separately supported and engaged so as to restrict movement of the user's body to rotary movement of the upper torso relative to the lower torso about an axis extending longitudinally of the user's body, and free weights are used to impose and to vary resistance to such movement. Additionally it would be advantageous to provide a mechanism that allows the user to engage the resistance at a desired degree of rotation and to vary the degree and direction of rotation. Lastly, it would be advantageous to provide such a rotary torso machine that may be easily converted to an effective back or abdominal exercise machine. Such a machine would be ideal for home or small gym use, where space for multiple exercise machines may be limited.

DISCLOSURE OF THE INVENTION

It is an object of the present invention to provide a novel method and apparatus for exercising the rotary torso muscles of the human body in a safe, efficient and accurate manner. The exercise machine of the present invention is particularly suited for commercial use in gyms and the like as it targets one muscle group. To accomplish this objective, the present invention is a rotary torso exercise device that works on the torso or mid-section of the body. Specifically, the exercises performed using the device isolate and target the internal and external oblique muscles on both sides of the midsection as well as providing some conditioning to the rectus abdominis muscle.

The device is an exercise machine on which a user's body is supported in a generally supine position. The machine is comprised of a frame structure with an upper torso support (including a head and back rest), a lower torso support (including a seat) and feet stabilizing rollers, aligned longitudinally. While the lower torso support and rollers remain fixed during the exercises, the position of these features relative to upper torso support along the longitudinal axis is adjustable depending upon the size of the user. Attached to the upper torso support are right and left side bars with handles which the user grips for added support and to maintain proper positioning throughout the exercise. The upper torso support is rotatably attached to the frame. In use, the user's upper and lower torsos are engaged so as to restrict movement of the user's body to rotary movement of the upper torso relative to the lower torso about an axis extending longitudinally of the user's body, and force is imposed to resist such movement. Resistance to the rotation movement is provided by free weights.

In one embodiment the head of the frame contains a through bore with an axle mounted there-through. Fixedly attached to the one end of the axle is a weight bar. Attached to the opposite end of the weight bar is a peg for removably mounting free weights. Attached to the inner end of the axle is the upper torso support. In use, the user, holding the handles on the side bars rotates his upper torso to turn the axle. The weights on the weight bar provide resistance.

This embodiment further comprises a hand control mechanism in which releasing the hand control releases tension on a wire and thereby engages a pin into one of a plurality of wholes encircling the perimeter of a disk that is fixedly attached to the axle. When the pin is engaged, the upper torso support remains in a fixed position about the axle, and rotation of the upper torso support is met with resistance from the weights. Depressing the hand control mechanism tenses the wire and disengages the pin from the disk. When the pin is disengaged, the upper torso support may rotate freely about the axle without resistance. Varying the position of the pin, varies the position of the upper torso support relative to the position of the weight bar, thereby allowing the user to vary the degree of rotation about the user's longitudinal axis during which resistance is imparted as well as the direction of resistance.

In another embodiment, the right and left side bars of the upper torso support are formed from a single U-shaped bar. Multiple weight pegs are attached to the U-shaped bar for holding the free weights used to provide resistance during the rotary torso exercises. The relative positions of the weight pegs (and thus the weights) about the U-shaped bar are adjustable to vary the degree of rotation about the user's longitudinal axis during which resistance is imparted as well as the direction of resistance. Multiple bearings are mounted on the frame to form a track through which the U-shaped bar is guided as the user rotates the upper torso support.

Another object of the present invention is to provide such a rotary torso device, ideal for home use, that may be easily converted to perform abdominal and back exercises by connecting an additional cushioned bar to one of the handles, adjusting the seat (lower torso support) position to be aligned with the additional cushioned bar and changing the position of the feet stabilizing rollers to align with the seat, perpendicular to the longitudinal alignment of the frame. The ability to change the position of the rollers is accomplished by either a pivoting mechanism within the frame or by providing multiple receivers about the frame to receive the rollers at a desired position.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

BEST MODE OF CARRYING OUT THE INVENTION

While the present invention will be described more fully hereinafter with reference to the accompanying drawings, in which the best mode of carrying out the present invention is shown, it is to be understood that the invention herein described may be modified by those skilled in the art of the invention, while still achieving the favorable results of this invention. Accordingly, the description which follows is to be understood as being a broad, teaching disclosure directed to persons of skill in the appropriate arts, and not as limiting upon the present invention.

Figure 1:
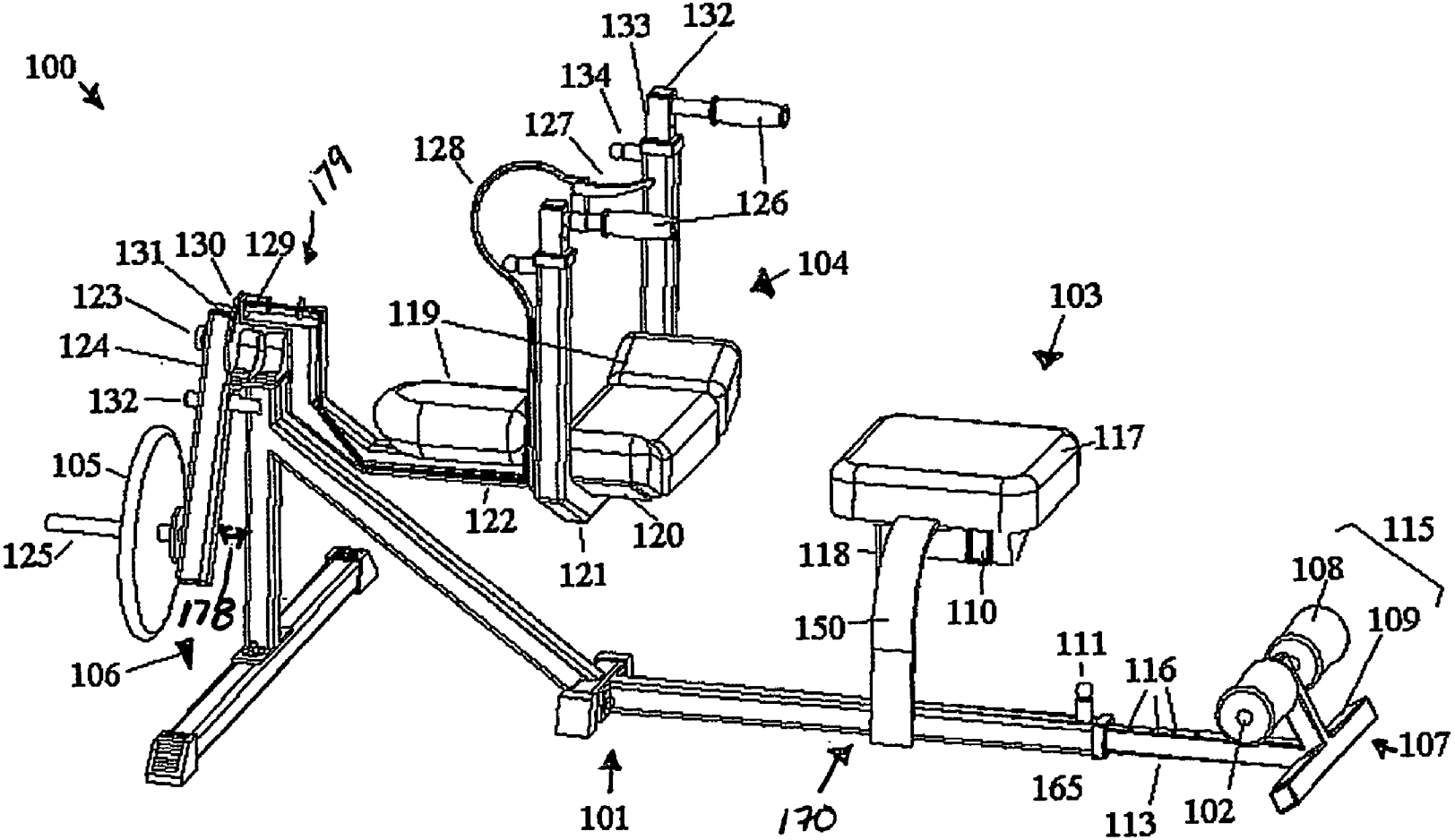
FIG. 1 is a side view drawing of the preferred embodiment of the rotary torso machine of the present invention.

The rotary torso exercise machine of the present invention is essentially an exercise machine on which a user's body is supported in a generally supine position. FIGS. 1 and 3 illustrate two similar embodiments of a rotary torso machine (FIG. 1, 100 and FIG. 2, 200). Both embodiments are comprised of five main features: (1) a freestanding frame (101, 201), (2) feet stabilizing rollers (102, 202), (3) a fixed lower torso support or seat (103, 203), (4) a rotatable upper torso support (104, 204) connected (directly or indirectly) to the frame 102, 201, and (5) a peg (125, 225) for holding free weights (105, 205) that impart resistance against the rotation of the upper torso support (104, 204).

The frame (101, 201) is the supporting structure preferably made of commercial grade hollow 2" square steel tubing having a first end 106, 206 and a second end 107, 207. However, those skilled in the art will recognize that other materials may be suitable for constructing the frame. The upper torso support 104, 204, lower torso support 103, 203 and rollers 102, 202, are connected to the frame 101, 201 such that they maintain the position of the user's upper torso, lower, and feet, respectively, in a generally supine position along the longitudinal axis extending the length the frame from the first end 106, 206 to the second end 107, 207. While the lower torso support 103, 203 and rollers 102, 202 remain fixed during the exercises, the position of these features along the length of the frame may be adjusted by adjustment mechanisms 110 and 111 (See FIG. 1 and discussion below), respectively, to accommodate users of various sizes.

The rollers 102, 202 are rotatably mounted to the frame 101, 201 at the second end 107, 207. The rollers 102, 202 are preferably wrapped in a padded cushion 108, 208 for comfort. Referring to FIG. 1, the rollers 102 may be one element of an adjustable position foot hold 115, also including an integral foot rest 109 and a connecting bar 113. The foot hold 115 is designed immobilize the user's feet during the exercise. The preferred means of connecting the foot hold 115 onto the frame 101 is to slide a horizontal connecting bar 113 into a receiver 165 at the second end 107 of the frame 101. Bar 113 further includes a plurality of holes 116 aligned along the length of bar 113. As the user slides the bar 113 into the frame, the user pulls up adjustment mechanism 111 (i.e. a simple peg or a spring loaded peg) which allows the bar 113 to slide freely into the frame 101 for lateral adjustment. When the mechanism 111 is released, the bar 113 is engaged securing the foot hold 115. Optionally, the adjustable foot hold 115 may be configured with a vertical positioning feature to allow the user to adjust not only the relative position of the foot hold 115 along the longitudinal axis, but also the height of the foot hold 115.

Again referring to both FIGS. 1 and 3, the lower torso support 103, 203 is comprised of a pedestal 118, 218 welded or otherwise attached along a midsection 170, 270 to frame 101, 201. A cushioned seat 117, 217 is slideably attached to the top of pedestal 118, 218 by bracket 110, 210 (or otherwise) thereby allowing the user to adjust the lateral position of seat 117, 217 relative to the upper torso support 104, 204 and the feet stabilizing rollers 102, 202, along the longitudinal axis. Optionally, the lower torso support 103, 203, may include a seatbelt 150, 250 to immobilize the user's lower torso during the exercise.

Figure 2:
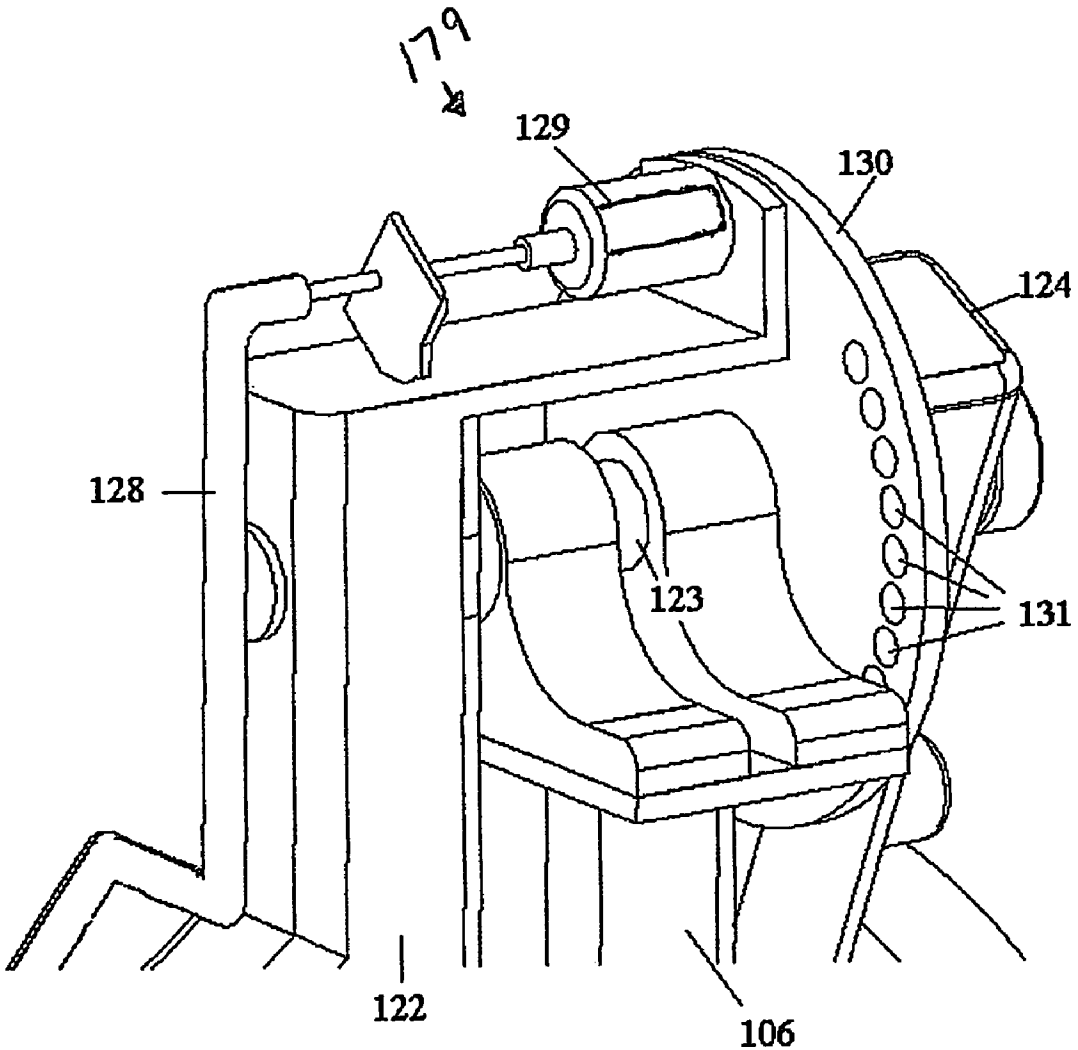
FIG. 2 is an exploded drawing of the pin mechanism for varying the position of the upper torso support relative to the weight bar.
Figure 3:
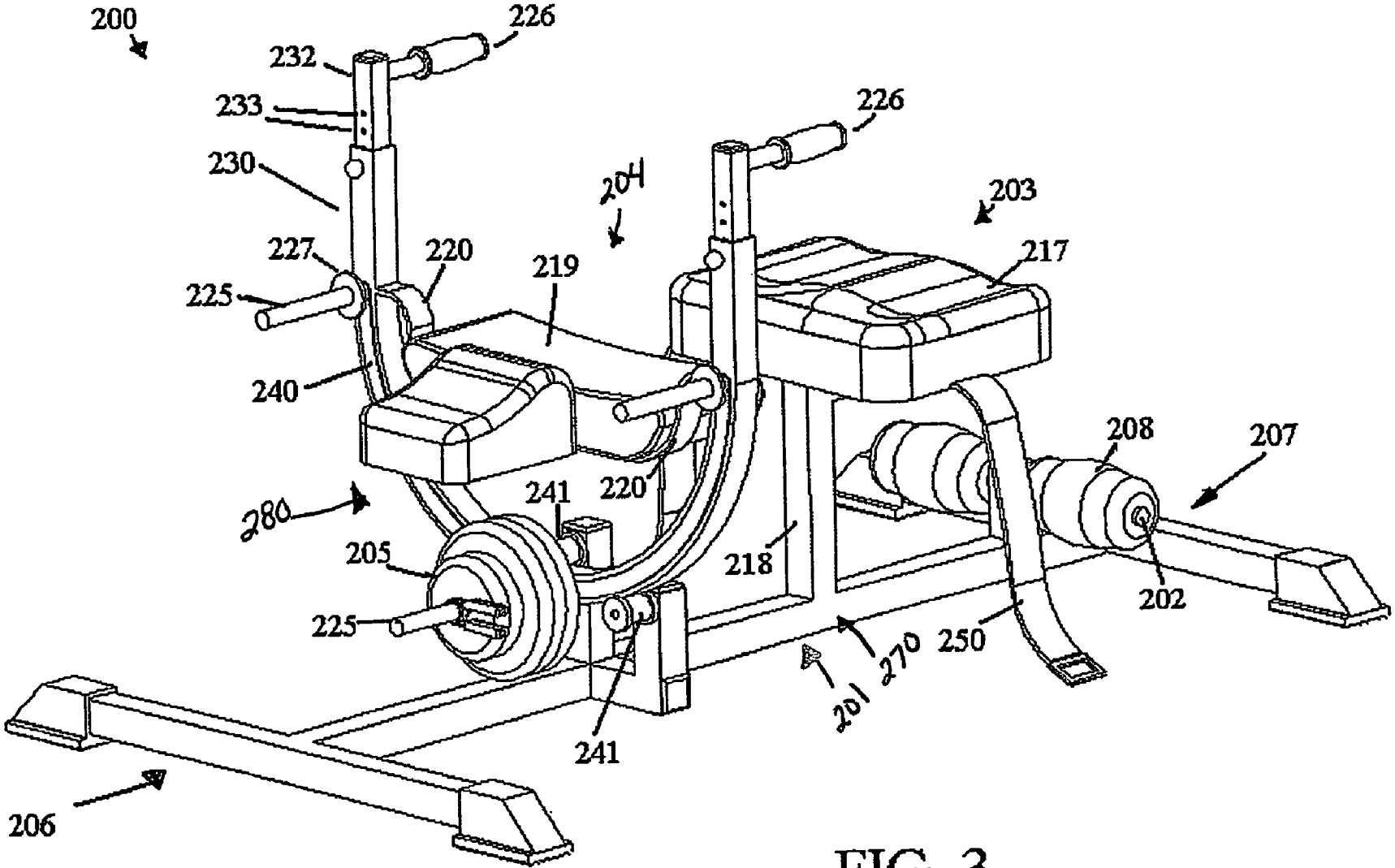
FIG. 3 is a side view drawing of an alternative embodiment of the present invention.

In the preferred embodiment, referring in combination to the illustrations in FIG. 1 and the exploded drawing of FIG. 2, the upper torso support 104 is designed to support the head, shoulders and upper torso of the user in a supine position. It is comprised of one or more cushions 119, attached to and supported by a rigid flat head/back rest structure 120. The upper torso support 104 is further comprised of left and right side bars 121 as well as a center support bar 122 molded or otherwise attached to the head/back rest 120. Side bars 121 and support bar 122 are ideally formed from the same hollow steel tubing as the frame 101. The center support bar 122 of the upper torso support 104 is rotatably attached to the first end 106 of the frame 101. The preferred means of rotatably attaching the center support arm 122 to the first end 106 includes a through bore (not shown) on the center support arm 122 for mounting the it onto one an axle 123, such that it may rotate about the axle 123. The axle 123 is in turn mounted on bushings or bearings (not shown) installed either in a corresponding through-bore in the first end 106 of frame 101 or in a bearing block mounted atop first end 106 that extends along the longitudinal axis of the frame. The axle 123 extends into another through-bore (not shown) in one end of yet another support bar (weight support arm 124) where it is fixedly attached. The opposite end of weight support arm 124 has an attached protruding peg 125 for supporting free weights 105.

Attached to the side bars 121 are adjustable handles 126 for providing the user with additional support and bracing during exercises. As with the foot hold 115, the preferred means of connecting the handles 126 onto the sidebars 121 is to slide a connecting bar 132 into the hollow of the side bar 121. Connecting bar 132 further includes a plurality of holes 133 aligned along the length of bar 132. As the user slides the bar 132 into the frame, the user pulls up mechanism 134 (i.e. a simple peg or a spring loaded peg) which allows the bar 132 to slide freely into the side bar 121, adjusting the height of the handles 126. When the mechanism 134 is released, the bar 132 is engaged securing the handles 126.

Attached to one of the handles 126 is a hand controlled actuator 127 connected to cable 128. The cable 128 is in turn connected to a pin mechanism 179 (i.e. spring loaded pin mechanism) that is fixed to the support bar 122 adjacent the axle 123. Fixedly attached to axle 123 is a disk 130 having a plurality of holes 131 adjacent its perimeter for engagement with the pin mechanism 179. Depressing and releasing the actuator 127 pulls and releases the cable 128, respectively, and thereby selectively disengages and engages (locks) the pin 129 of spring loaded pin mechanism 179 into disk 130. When the pin 129 is engaged in a hole 131, the support bar 122 is effectively fixed or locked to the axle 123, such that rotation of support bar 122 rotates the axle 123, which meets resistance imparted by weights 105 on arm 124. When the pin 129 is disengaged from a hole 131, the support bar 122 is free to rotate about the axle 123 in order to vary the position of the pin. Varying the position of the pin 129 engaged in the disk 130, varies the position of the upper torso support 104 relative to the position of the weight support 124, thereby allowing the user to vary the degree of rotation about the user's longitudinal axis during which resistance is imparted as well as the direction of resistance.

The weight support arm 124 is further comprised of an optional stopping mechanism 132 (i.e. peg or spring loaded peg mechanism), which may be engaged on either side of the frame 101 and when engaged prevents the weight support 124 from rotating beyond a predetermined angle 178 relative to the frame 101 (i.e. stops the arm 124 at an angle of 25 degrees from perpendicular).

In operation of the above-described device, the user places free weights 105 on weight peg 125. The user then sits on lower torso support 103, placing his feet in foot hold 115 and lying back onto upper to support 104. In the preferred position the lower back remains flat. Holding handles 126, the user depresses actuator 127, rotates upper torso support 104 to the desired starting position, and releases actuator 127. The user then begins the rotation exercise against the resistance imparted by weights 105.

In the alternate embodiment illustrated in FIG. 3, the upper torso support 204 is similarly designed to support the head, shoulders and upper torso of the user. Upper torso support 204 is comprised of one or more cushions 219, attached to and supported by head/back rest structure 220. Attached to the head/back rest 220 is a U-shaped bar 230 forming right and left side bars 221 to the upper torso support 204. The semi-circular base 280 of the U-shaped bar 230 forms the means for rotating the upper torso. As with the embodiment illustrated in FIG. 2, adjustable handles 226 are connected to the side bars 221.

In this alternate embodiment of FIG. 3, the U-Shaped bar 230 further includes a hollow track 240. Multiple weight pegs 225 are seated in the track 240. Free weights 205 are placed on one or more pegs 225 to impart resistance during the rotation exercises. Each peg 225 has an engagement mechanism 227 (i.e. screw or quick release) that when engaged fixes the position of the peg 225 seated in the track 240 and when disengaged allows the peg 225 to slide in the track. Varying the position of the weight pegs 225 allows the user to vary the position of the weights 205 and, thereby, the direction of resistance and the degree of rotation during which resistance is imparted. At least three roller bearings 241 are mounted on the frame 201. The bearings 241 secure the U-shaped bar 240 vertically to the frame 201 and guide the U-shaped bar 240 in a smooth rotation about the longitudinal axis extending the length of the frame as the user rotates his upper torso.

In operation, the user adjusts the position of the weight pegs 225 in track 240. The user then places free weights 205 on one of the pegs 225. The position of the weights 225 about the track causes the U-shaped bar 230 to rotate and thereby vary the starting position of the exercise and the degree and direction of rotation of the exercise. The user sits on lower torso support 204, hooking feet under rollers 202 and lays back into upper torso support 204. Holding handles 126, the user begins the rotation exercises.

Another object of the present invention is to provide a rotary torso device, such as those illustrated in FIGS. 1 and/or 2, that may be easily converted to perform abdominal and back exercises. The means for converting the rotary torso device of the present invention into a back and/or abdominal exercise machine is illustrated herein with regards the embodiment illustrated in FIG. 1. However, the same modifications may be applied to the device of FIG. 2.

Figure 4:
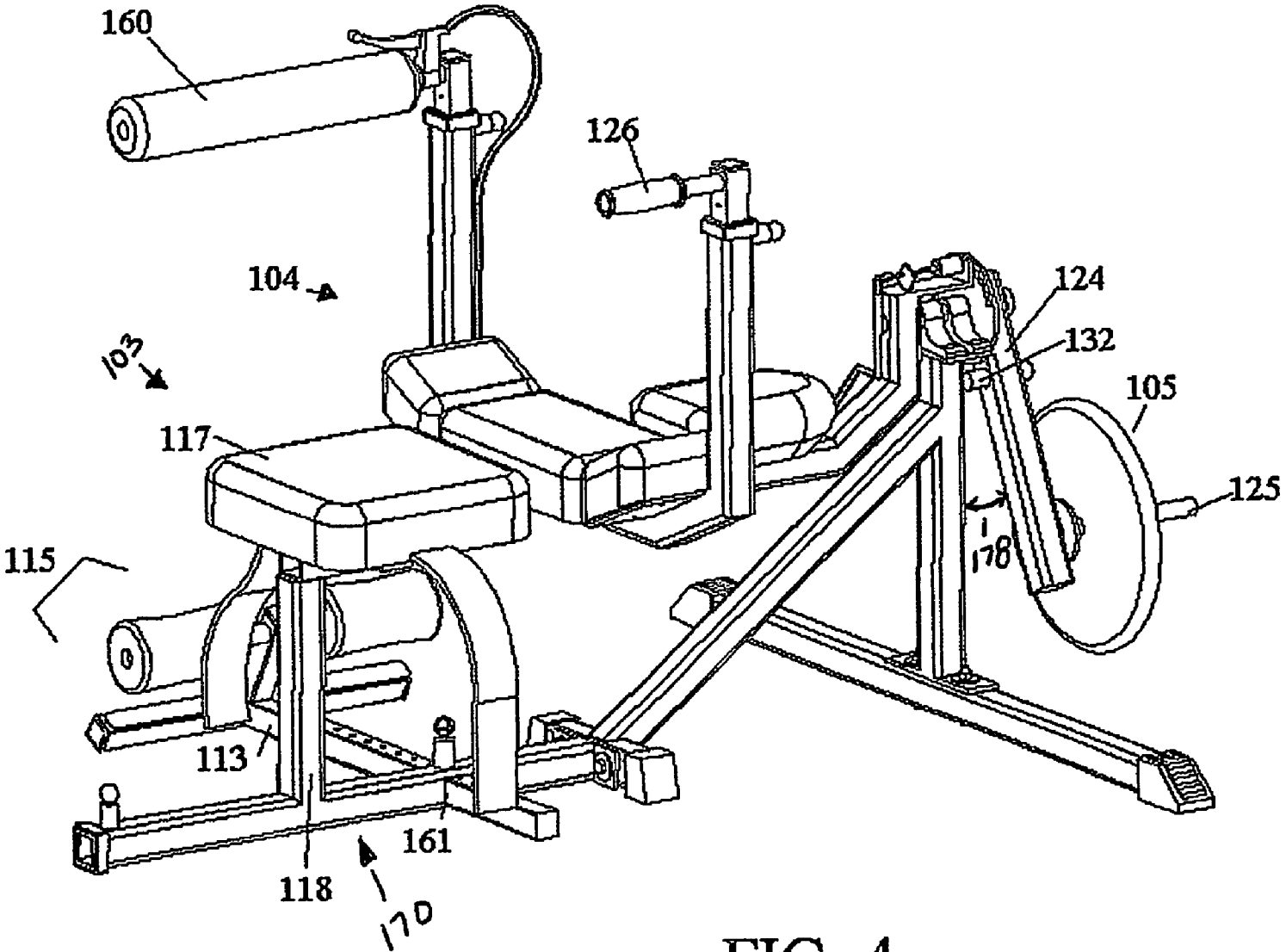
FIG. 4 is a drawing of the preferred modification of the rotary torso machine of FIG. 1 for use as an abdominal exercise machine.
Figure 5:
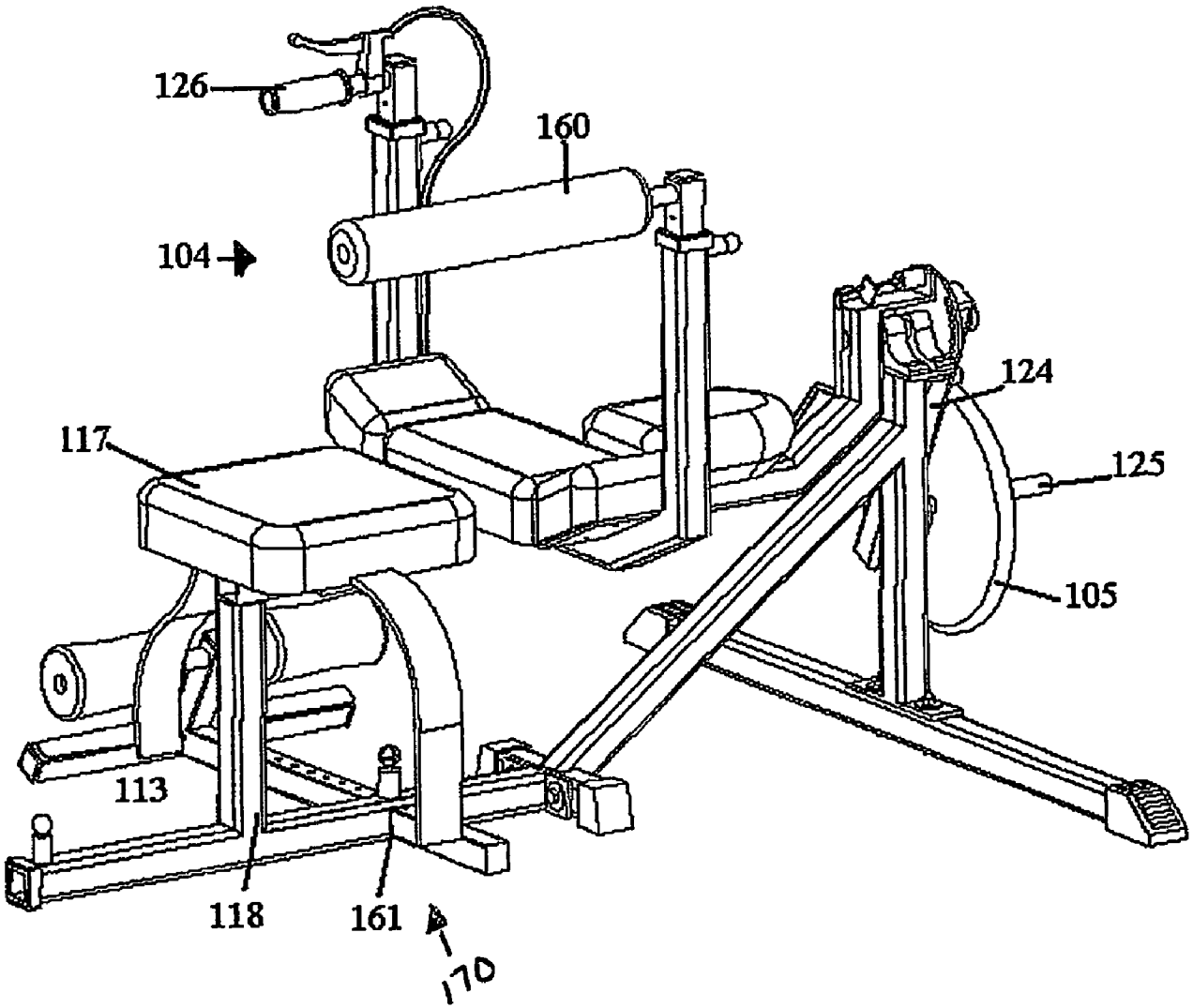
FIG. 5 is a drawing of the preferred modification of the rotary torso machine of FIG. 1 for use as a back exercise machine.

Referring to FIGS. 4-7 combined, the modifications may be accomplished by sliding a cushioned hollow bar 160 onto one of the handles 126, adjusting the position of the seat 117 so that it is positioned adjacent to the upper torso support 104 and changing the position of the foot hold 115 to align with seat 117 perpendicular to the longitudinal axis extending the length of the frame 101. When the cushioned bar 160 and foot hold 115 are positioned on the same side of frame 101, the device is modified for use as an abdominal exercise machine (FIGS. 4 and 6). When the cushioned bar 160 and the foot hold 115 are positioned on opposite sides of the frame 101, the device is modified for use as a back exercise machine (FIGS. 5 and 7). In order to change the position of the seat 117 and foot hold 115, the frame 101 may be modified in one of two ways.

Figure 6A:
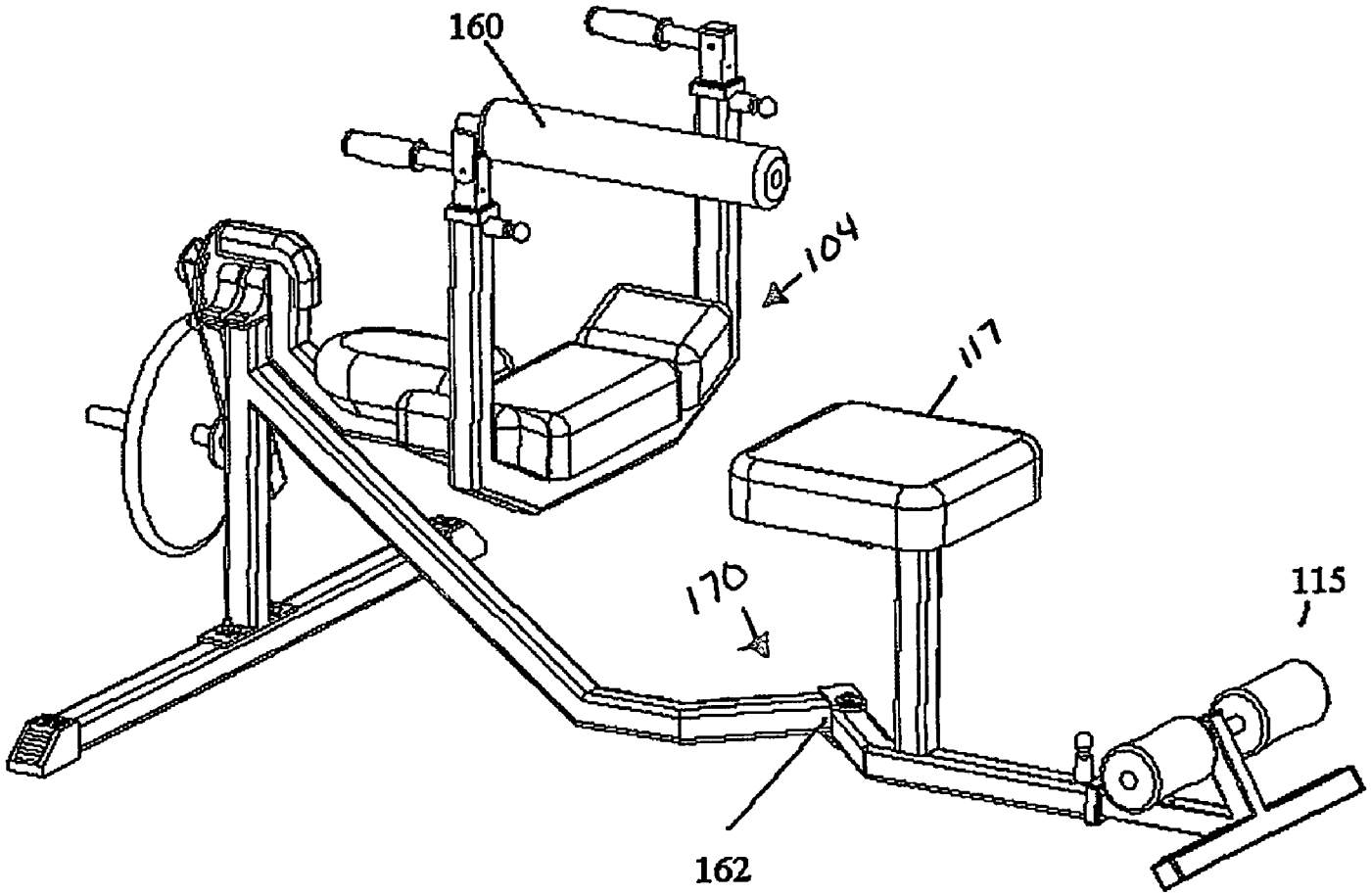
FIGS. 6*a-b* is a drawing of an alternate modification of the rotary torso machine of FIG. 1, for use as an abdominal exercise machine.
Figure 6B:
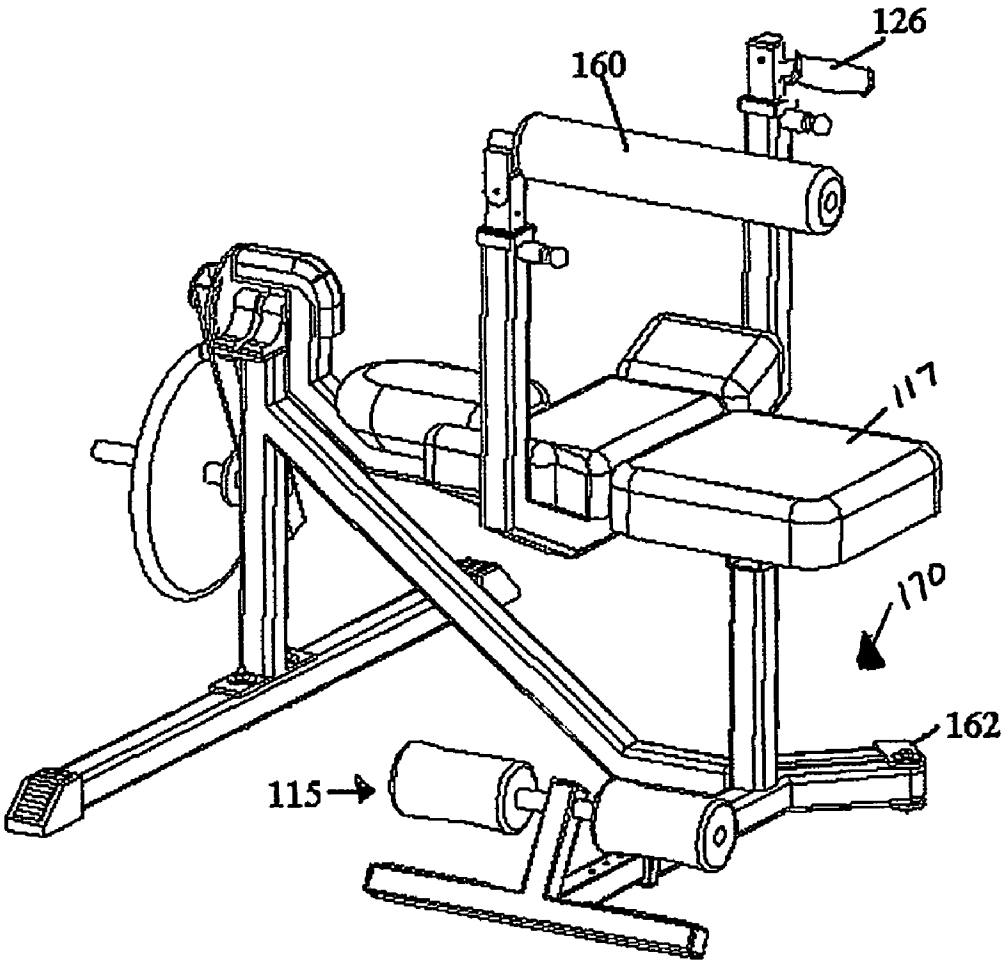
Figure 7A:
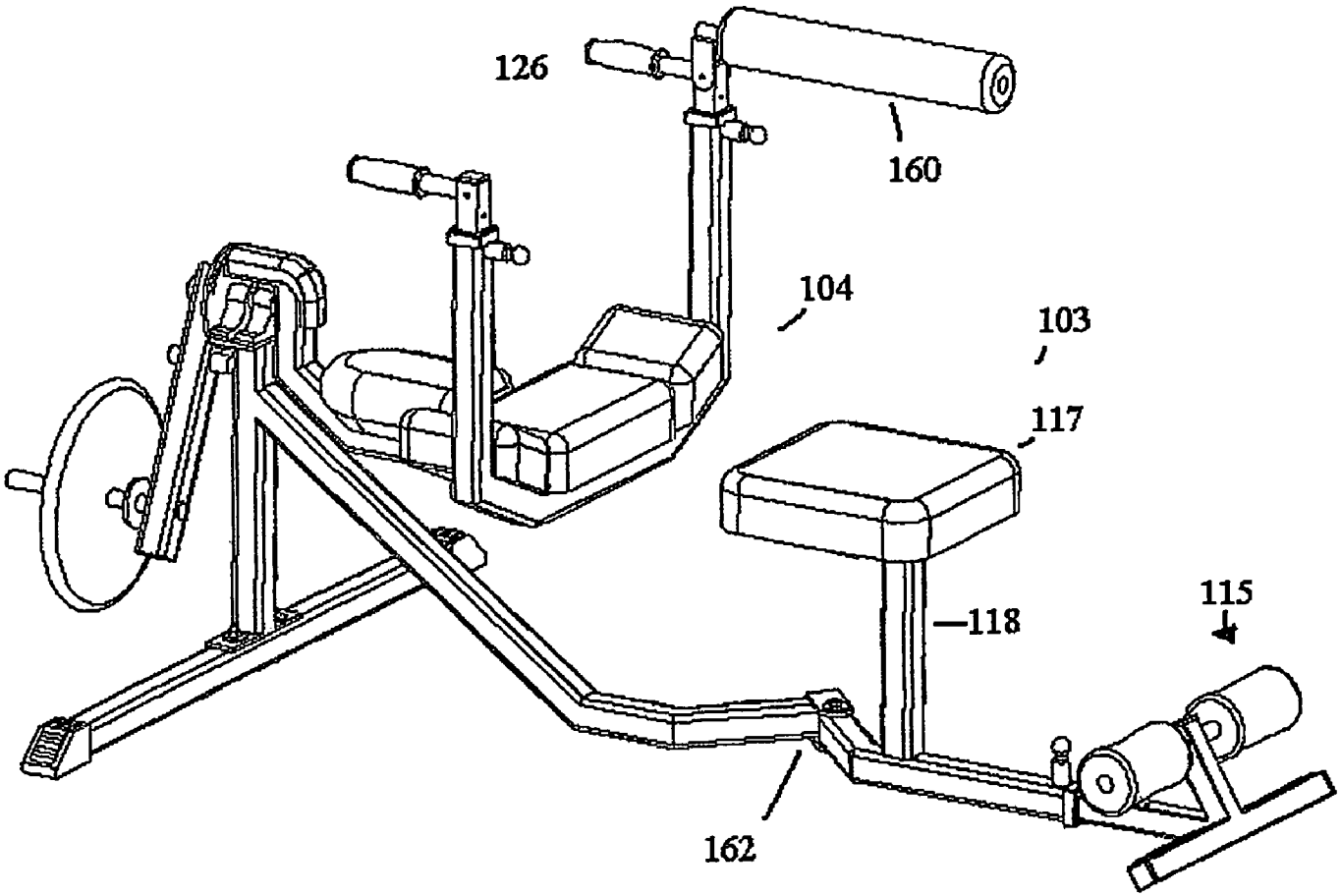
FIGS. 7*a-b* is a drawing of an alternate modification of the rotary torso machine of FIG. 1 for use as a back exercise machine.
Figure 7B:
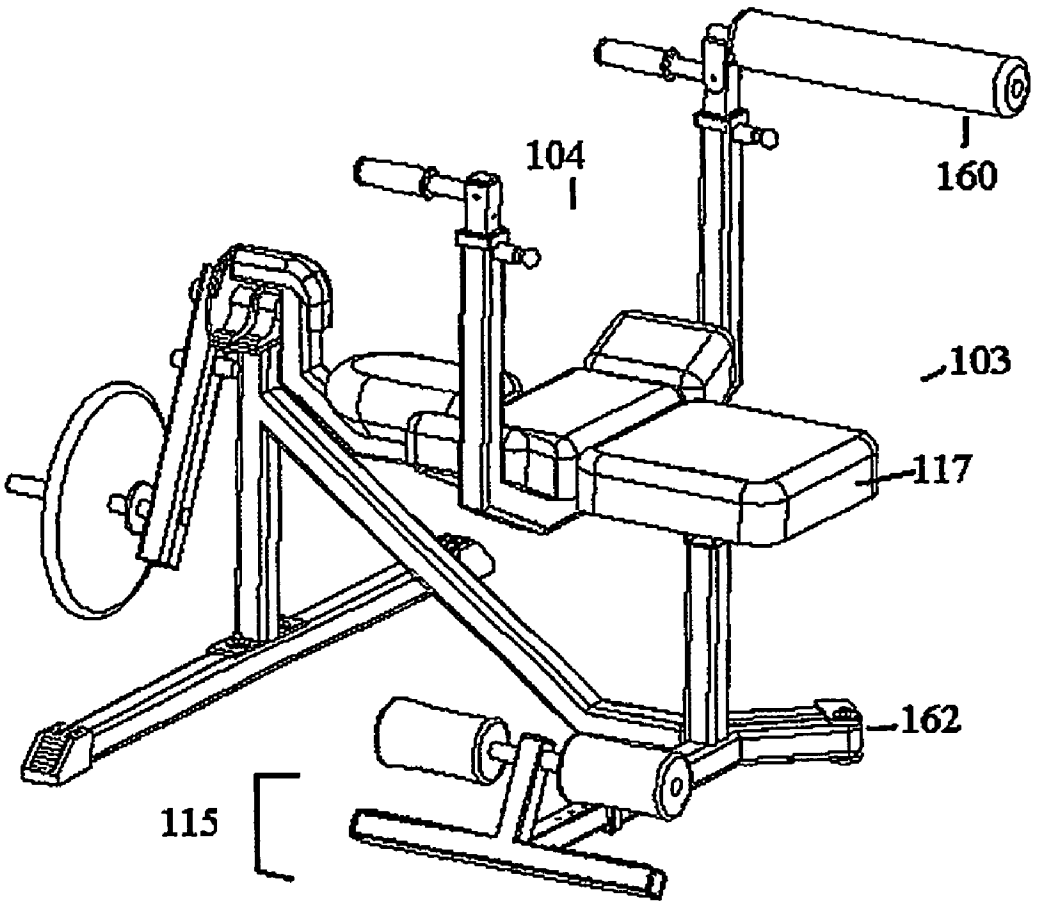

In the embodiment illustrated in FIGS. 4 and 5, the midsection 170 of frame 101 is configured with a hollow cross bar 161 for receiving the connecting bar 113 of the foot hold 115 from either side of the frame 101. The cushioned seat 117 is slidably attached to the top of pedestal 118 so that the user may adjust the position of seat 117 adjacent to the upper torso support 104. Alternatively, as illustrated in FIGS. 6 and 7, the midsection 170 of frame 101 is configured with a lockable pivoting joint 162 (locked position 1 (FIGS. 6*a* and 7*a*) and locked position 2 (FIGS. 6*b* and 7*b*). In position 1, the frame 101 is configured for use as a rotary torso machine. In position 2, the frame 101 is pivoted about the joint 162, moving the seat 117 adjacent to the upper torso support 104 and foot hold 115 in perpendicular alignment with the length of the frame 101.

In operation, the abdominal and back exercises are performed in a seated on seat 117 with feet secured in foot hold 115. The user will add weights 105 and adjust the degree and direction of rotation, as discussed above. Abdominal exercises are performed by the using abdominal muscles to push forward on the cushioned bar 160. Back exercises are performed by using the back muscles to push backwards against the cushioned bar 160.

In light of the foregoing, it should be apparent that the rotary torso machine of the present invention provides a unique exercise machine for safely and effectively targeting the rotary torso muscles, and thus ideally suited for commercial use in gyms and the like. It should also be apparent that such a rotary torso machine that is easily converted to a safe and effective abdominal or back exercise machine is ideally suited for use in homes, small gyms or the like.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

INDUSTRIAL APPLICABILITY

There is a significant commercial demand for exercise stations suited for commercial use in gyms and the like that safely and effectively target one muscle group, and particularly the rotary torso muscles. The above-described rotary torso exercise machine places the user in the best position for carrying out rotary torso exercises, namely supine with hips at least slightly extended and feet and lower torso immobile. The device further allows the user to vary the direction and degree of resistance imparted during the exercise. Additionally, the rotary torso exercise machine is easily convertible to target other exercise groups, such as a safe and effective abdominal or back exercise machine, making it well-suited for small gyms or the like.

I claim:

1. A rotary torso exercise machine, comprising:

a freestanding frame including two opposing ends, wherein said ends comprise a first end and a second end; and a mid-section between said ends;

an upper torso support rotatably attached to a first end of said frame for supporting a user's upper torso in a supine position;

a lower torso support attached along a mid-section of said frame, said lower torso support for supporting a user's lower torso in alignment with the upper torso in said supine position;

feet stabilizing rollers attached to a second end of said frame for stabilizing the user's feet in said supine position; and, a peg protruding from said upper torso support, for holding free weights to impart resistance against rotation of said upper torso support.

2. The rotary torso exercise machine, according to claim 1, wherein said frame is comprised of hollow tubing.

3. The rotary torso exercise machine, according to claim 1, wherein said upper and lower torso supports further comprise cushioning for comfort.

4. A rotary torso exercise machine comprising: a freestanding frame: an upper torso support rotatably attached to a first end of said frame for supporting a user's upper torso in a supine position: a lower torso support attached alone a mid-section of said frame, said lower torso support for supporting a user's lower torso in alignment with the upper torso in said supine position wherein said lower torso support further comprises a pedestal fixed to a mid-section of said frame and a cushioned seat adjustably attached to said pedestal for lateral positioning along said frame: feet stabilizing rollers attached to a second end of said frame for stabilizing the user's feet in said supine position: and, a peg protruding from said upper torso support, for holding free weights to impart resistance against rotation of said upper torso support.

5. A rotary torso exercise machine comprising: a freestanding frame: an upper torso support rotatably attached to a first end of said frame for supporting a user's upper torso in a supine position: a lower torso support attached along a mid-section of said frame, said lower torso support for supporting a user's lower torso in alignment with the upper torso in said supine Position: feet stabilizing rollers attached to a second end of said frame for stabilizing the user's feet in said supine position wherein said feet stabilizing rollers further comprise opposing foot rests mounted on a connecting bar, said connecting bar for adjustably connecting said feet stabilizing rollers to said frame: and, a peg protruding from said upper torso support, for holding free weights to impart resistance against rotation of said upper torso support.

6. The rotary torso exercise machine, according to claim 5, wherein said connecting bar is a telescoping connecting bar inserted into said frame, said connecting bar being defined by a plurality of holes along its length, and said frame further comprising a peg mechanism for engaging and disengaging the holes of said sliding connecting bar to adjust the lateral position of said foothold relative to said frame.

7. The rotary torso exercise machine, according to claim 6, wherein said rotatable upper torso support supports the head, shoulders and upper torso of the user during rotation exercises and further comprises left and right side bars with handles for providing the user with additional support and bracing during exercises.

8. The rotary torso exercise machine, according to claim 7, further comprising a weight support arm and a pin mechanism; said weight support arm being rotatably attached at one end to the first end of said frame, the other end of said weight support arm having a protruding peg for holding said free weights; said pin mechanism selectively locking the weight support arm at one of a variety of angular positions relative to said upper torso support; and whereby when free weights are held on the peg of said weight support arm and said pin mechanism is engaged to lock the weight support arm relative to said upper torso support, the user's upper and lower torsos are engaged so as to resist rotary movement of the upper torso relative to the user's lower torso against a weight of said free weights.

9. The rotary torso exercise machine, according to claim 8, wherein said upper torso support is further comprised of a head/back rest and a center support bar; and wherein rotatably mounted in the first end of said frame is an axle; fixedly attached to one end of said axle is said weight support arm and rotatably attached on the other end of said axle is said center support bar.

10. The rotary torso exercise machine, according to claim 9, wherein fixedly attached to said axle is a disk having a plurality of holes adjacent its perimeter; wherein said pin mechanism is comprised of a cable connected to a pin and is fixed to said center support bar adjacent said axle; and wherein one of said handles further comprises a hand controlled actuator; whereby, depressing and releasing the actuator actuates the pin mechanism by pulling and releasing the cable, respectively, disengaging and engaging the pin with one of the holes of said disk such that when the disk is engaged the center support bar is locked to the axle and rotation of the center support bar meets resistance imparted by the free weights held on the weight support arm and when the disk is disengaged the center support bar freely rotates about the axle; thereby the user may vary the position of the upper torso support relative to the position of the weight support arm in order to vary the degree of rotation about the user's longitudinal axis during which resistance is imparted as well as the direction of resistance.

11. The rotary torso exercise machine, according to claim 8, wherein said weight support arm is further comprised of a stopping mechanism which may be engaged to prevent movement of the weight support arm beyond a predetermined angle.

12. The rotary torso exercise machine, according to claim 7, wherein said upper torso support is comprised of a head/back rest attached to a U-shaped bar; said U-shaped bar forming said right and left side bars and having a semi-circular base; and wherein said frame further comprises at least three bearings for vertically securing the semi circular base of the U-shaped bar to the frame and for guiding the it in a smooth rotation as the user rotates his upper torso.

13. The rotary torso machine, according to claim 12; wherein said U-shaped bar is further comprised of a hollow track extending the length of the semi-circular base; wherein slideably seated in said track are multiple weight pegs, said weight pegs for holding the free weights for imparting resistance during the rotation exercises; and wherein each of said weight pegs is further comprised of an engagement mechanism for fixing the position of the weight peg in said track; whereby, varying the position of said weight pegs in said track allows the user to vary the position of the weights and, thereby the direction of resistance and the degree of rotation during which resistance is imparted.

14. The rotary torso machine of claim 7, convertible for use as either a back or abdominal exercise machine by repositioning said seat adjacent said upper torso support, repositioning said foot hold perpendicular to said longitudinal axis extending the length of said machine and aligned with said seat, and mounting a cushioned bar on one of said handles; wherein mounting the cushioned bar on the opposite side of the machine as the foot hold converts the machine for use as a back exercise machine and mounting the cushioned bar on the same side of the machine as the foot hold converts the machine for use as an abdominal exercise machine.

15. The rotary torso machine, according to claim 7, wherein said lower torso support is further comprised of a seat belt for immobilizing the user's lower torso.

* * * * *